US005497981A

United States Patent [19]

Case

[11] Patent Number: 5,497,981

[45] Date of Patent: Mar. 12, 1996

[54] MITER CLAMP

[76] Inventor: Milford D. Case, 14313 French Prairie Rd. NE., Woodburn, Oreg. 97071

[21] Appl. No.: 263,517

[22] Filed: Jun. 22, 1994

[51] Int. Cl.[6] ..... B25B 1/20

[52] U.S. Cl. ..... 269/37; 269/203; 269/45; 269/204

[58] Field of Search ..... 269/37, 45, 41, 269/203, 204, 307, 79, 82, 83, 84, 85

[56] References Cited

U.S. PATENT DOCUMENTS

| | | | |
|---|---|---|---|
| 1,084,130 | 1/1914 | Cargin | 269/45 |
| 1,126,053 | 1/1915 | McGough | 269/45 |
| 1,306,858 | 6/1919 | Salter | 269/45 |
| 3,072,396 | 1/1963 | McBurney | 269/45 |
| 3,888,476 | 6/1975 | Barton . | |
| 4,023,787 | 5/1977 | Violette . | |
| 4,163,547 | 8/1979 | Jerome . | |
| 4,949,944 | 8/1990 | Groff | 269/45 |
| 5,058,870 | 10/1991 | Cetnar . | |
| 5,192,059 | 3/1993 | Silver | 269/45 |
| 5,401,354 | 3/1995 | Colucci | 269/37 |
| 5,405,124 | 4/1995 | Mayer et al. | 269/45 |

FOREIGN PATENT DOCUMENTS

3922140A1 7/1989 Germany .

*Primary Examiner*—Robert C. Watson

*Attorney, Agent, or Firm*—Klarquist, Sparkman, Campbell, Leigh & Whinston

[57] ABSTRACT

A clamping device operable to clamp work pieces together at an obtuse angle. The device includes an elongate support bar having an angle element attached thereto and projecting outwardly at the obtuse angle from the support member. A clamping projection is mounted on a sleeve that is shiftable longitudinally along the support member toward and away from the angle element. A locking mechanism is attached to the sleeve for securing the clamping projection in a selected position on the support member.

18 Claims, 1 Drawing Sheet

MITER CLAMP

TECHNICAL FIELD

This invention relates to a clamping device for clamping work pieces together at an obtuse angle.

BACKGROUND AND SUMMARY OF THE INVENTION

In the field of woodworking, glue or other adhesives are often used to join two or more pieces of wood. Many conventional clamping devices are constructed to hold work pieces together in an aligned or perpendicular relationship while the adhesive is cured. Many attempts have been made to provide clamping devices for clamping work pieces together at angles other than aligned or perpendicular relationships. For example, German Patent No. 3,922,140 describes an adjustable clamping device having a pair of elongate rails extending at variable angles to each other and joined by an intermediate rail. Semi-circular plates having arcuate slots formed therein are secured to the rails. The semi-circular plates are used to select a suitable angle formed between the elongate rails. Screw clamps extend through the slots and may be tightened to maintain the rails in the preselected angular position so that work pieces placed along the rails can be joined at the selected angle. However, this device is cumbersome to use and complicated to make. Therefore, there is a need for a simple, yet effective, clamping device for joining work pieces together at angles other than 90 and 180 degree angles.

The present invention provides a device for clamping work pieces together at obtuse angles. The device comprises an elongate support member having an angle element attached to and projecting outwardly at an obtuse angle from the support member. A clamping projection is mounted on a sleeve that is shiftable longitudinally along the support member toward and away from the angle element. A locking mechanism is operably attached to the sleeve for resisting sliding movement of the sleeve when the locking mechanism is in a locked position and for permitting sliding movement of the sleeve when the locking mechanism is in an unlocked position.

DETAILED DESCRIPTION OF THE INVENTION

Figures 1, 2, 3, 4:
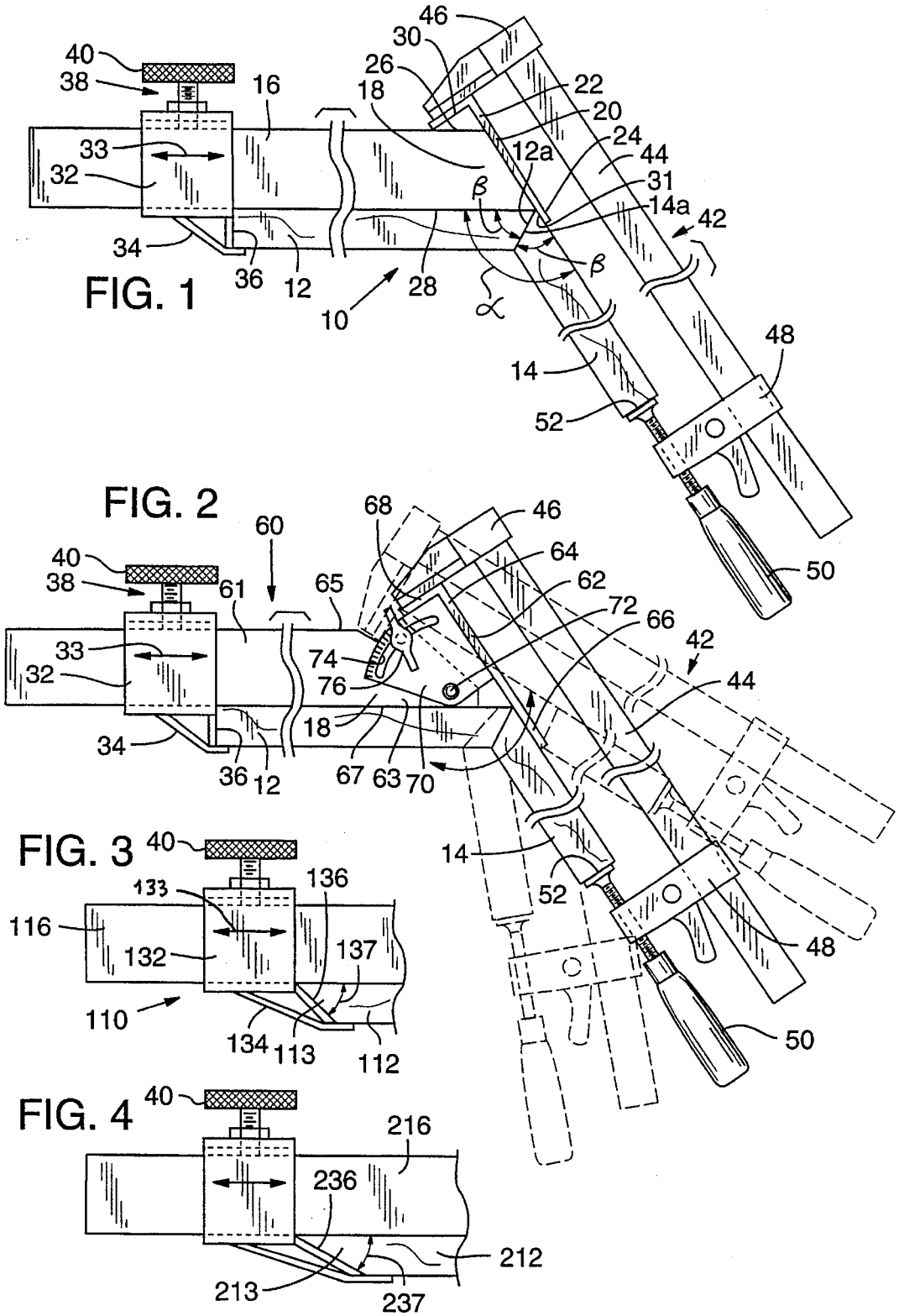
FIG. 1 is a side elevation view of a first embodiment of the clamping device of the present invention.
FIG. 2 is a side elevation view of a second embodiment of the clamping device of the present invention.
FIG. 3 is an elevation view of a portion of a third embodiment of the clamping device.
FIG. 4 is an elevation view of a portion of a fourth embodiment of the clamping device.

With reference to FIG. 1, a first embodiment of the present invention is illustrated wherein a clamping device 10 is adapted for clamping work pieces 12, 14 together at an obtuse angle α. It should be understood that clamping device 10 may be modified to join work pieces at acute and other suitable angles, if desired. Clamping device 10 includes an elongate, substantially rigid bar, or support member, 16. Bar 16 may have a variety of cross-sectional shapes including rectangular, round, triangular or any other suitable cross-sectional shape.

To one end portion 18 of elongate bar 16 is secured, as by welding, a positioning plate, or angle element, 20 which is disposed at the obtuse angle α relative to the longitudinal axis of bar 16. Positioning plate 20 comprises opposed upper and lower projections, or portions, 22, 24 extending away from opposite sides 26, 28 of bar 16. More particularly, side 28 of bar 16 is a work piece supporting surface and lower projection 24 has an inside surface 31 that defines the obtuse angle α with the work piece supporting surface of side 28.

Upper projection 22 includes a support plate, or support element, 30 extending substantially perpendicular to a plane of positioning plate 20. Of course, the support element may extend at other angles than perpendicular to the plane of the positioning plate. In the illustrated embodiment, one end of support element 30 is secured to upper projection 22 of positioning plate 20 and the opposite end is secured to upper side 26 of bar 16. However, the opposite end of support element 30 may be separate or spaced from upper side 26.

A sleeve 32 is mounted on and shiftable longitudinally along bar 16 toward and away from positioning plate 20 (as shown by arrows 33). Sleeve 32 has an angle clip, or clamping projection, 34 attached thereto and extending outwardly therefrom. The angle clip projects to the same side 28 of bar 16 as lower projection 24 and is adapted to hold work piece 12 placed along the support surface of lower side 28 and between angle clip 34 and positioning plate 20. Angle clip 34 includes a stop plate portion 36 extending outwardly from and perpendicular to the longitudinal axis of bar 16.

Sleeve 32 includes a screw locking mechanism, or locking means, 38 for securing the sleeve in a selected position on bar 16. Locking mechanism 38 comprises a screw 40 extending through a threaded bore in sleeve 32. Locking mechanism 38 is adapted to inhibit sliding movement of sleeve 32 when the inner end of screw 40 is pressed tightly against bar 16 and thus the locking mechanism is in a locked position. It permits sliding movement of the sleeve when screw 40 is backed away from bar 16 and the locking mechanism thus is in an unlocked position. It should be understood that other suitable locking mechanisms may be used. For example, upper surface 26 or lower surface 28 may be provided with transverse slots (not shown) to receive a projection such as a removable pin attached to the sleeve so that sliding movement of the sleeve is resisted when the pin extends into one of the slots.

A second conventional clamping device 42 may be used in conjunction with clamping device 10 to hold work piece 14 in edge-to-edge abutting relationship against work piece 12 held in clamping device 10 as described above. Clamping device 42 includes an elongate bar 44 having a stationary clamp unit 46 secured to an end portion of the bar and a movable clamp unit 48 slidably mounted on bar 44. Clamp unit 48 includes a conventional tightening screw 50. Work piece 14 may be urged against work piece 12 by placing clamp unit 46 on support element 30 and clamp unit 48 on an opposite end surface 52 of work piece 14 and then tightening screw 50 in a known manner.

The method for using the clamping system will be described as used to hold work pieces 12, 14 together in edge-abutting, angularly disposed relationship. Work pieces 12, 14 may be sheets of material, such as plywood, to be joined at mating edges **12*a*, 14*a*, as may be used in building cabinetry. As will be seen, the work pieces are to be joined together at the angle α, shown here to be about 135°. Their edges 12*a*, 14*a*** are formed at angles β which are each about 67½.

Explaining the method for clamping work pieces 12, 14 together according to the invention and using the system thus far described, sleeve 32 is slid outwardly away from position plate 20 to make room for work piece 12 which then is placed between stop plate 36 and lower projection 24. Work piece 14 is moved into edge-abutting position with work piece 12, as illustrated in FIG. 1, so that inside surface 31 supports work piece 14 and the support surface of side 28 supports work piece 12. Preferably, glue or any other adhesive is applied to one or both of the work pieces before they are joined. Sleeve 32 is slid inwardly towards position plate 20 until the sleeve abuts an end surface of work piece 12 so that work piece 12 is firmly held between angle clip 34 and position plate 20. Locking screw 40 is tightened to lock the position of sleeve 32 on elongate bar 16. Clamp unit 46 of clamping device 42 is placed on support element 30 and clamp unit 48 on end surface 52 of work piece 14. Screw 50 is tightened so that work piece 14 is firmly held against work piece 12. The work pieces are held together by clamping devices 10, 42 until the glue or adhesive is cured so that the work pieces are adhered to each other at the obtuse angle illustrated.

In a second embodiment, as illustrated in FIG. 2, a clamping device 60 includes an elongate bar 61 having one end portion 63. An adjustable positioning plate, or angle element, 62 is pivotally connected to end portion 63 of bar 61 and is adjustable to project outwardly at selected angles from the longitudinal axis of bar 61.

Positioning plate 62 comprises opposed upper and lower projections 64, 66 extending away from opposite sides 65, 67, respectively, of elongate bar 61. Upper projection 64 includes a support plate 68 extending substantially perpendicular to the plane of positioning plate 62.

In the illustrated embodiment, positioning plate 62 includes an adjustment plate 70 pivotally attached to a pivot pin 72 at end portion 63 of bar 61. Adjustment plate 64 has an arcuate slot 74 formed therein for receiving a tightening screw 76. The tightening screw is received in a threaded bore in bar 61 and may be tightened against plate 70 to maintain the position plate 62 in a selected angular position so that work pieces 12, 14 placed in the clamping device may be joined at the selected angle.

Sleeve 32 is mounted on and shiftable longitudinally along elongate bar 61 toward and away from positioning plate 62. As described above, clamping device 42 may be used to exert pressure on work piece 14 to hold it in edge-abutting relation against work piece 12 placed in clamping device 60.

Explaining the method for clamping work pieces 12, 14 together according to the invention and using the second embodiment thus far described, the preferred angle is selected on adjustment plate 70 by rotating the plate about pivot pin 72. When the desired angle is set, screw 76 is tightened to maintain the positioning plate 62 in the preselected angular position so that work pieces 12, 14 placed in the clamping device may be joined at the selected angle. After the angular position of the positioning plate is set, the clamping device may be used in a manner similar to the method described for clamping work pieces together using the first embodiment.

In a third embodiment, partially illustrated in FIG. 3, a clamping device 110 includes an elongate bar, or support member, 116 having a sleeve 132 mounted thereon. Sleeve 132 is shiftable longitudinally along bar 116 (as shown by arrows 133). Sleeve 132 has an angle clip, or clamping projection, 134 attached thereto and extending outwardly therefrom. Angle clip 134 includes a stop plate portion 136 extending outwardly from a side of bar 116 and at an angle relative to the longitudinal axis of elongate bar 116 to form approximately a 45 degree angle therewith as indicated by arrows 137. The 45 degree stop plate permits a work piece 112 having a 45 degree inclined end portion 113 relative to the longitudinal axis of work piece 112 to be firmly supported by stop plate portion 136. The remaining components of the third embodiment are virtually identical to the other components of the first or second embodiments, as illustrated in FIGS. 1 or 2.

In a fourth embodiment, illustrated in FIG. 4, a stop plate portion 236 and the longitudinal axis of an elongate bar, or support member, 216 form approximately a 22.5 degree angle as indicated by an arrow 237. The 22.5 degree stop plate permits a work piece 212 having a 22.5 degree inclined end portion 213 relative to the longitudinal axis of work piece 212 to be firmly supported by stop plate portion 236. The remaining components of the fourth embodiment are virtually identical to the components of the first or second embodiments as illustrated in FIGS. 1 or 2.

While the present invention has been described in accordance with preferred embodiments, it is to be understood that various substitutions and alterations may be made thereto without departing from the spirit and scope of the appended claims.

I claim:

1. A clamping device for use in a clamping system to clamp work pieces together at an oblique angle, comprising:

an elongate support member having a work piece support surface;

an angle element attached to and projecting outwardly at an oblique angle from the work piece support surface;

a clamping projection movable longitudinally along the support member toward and away from the angle element; and locking means for securing the clamping projection in a selected position on the support member wherein a work piece can be located against the work piece support surface between the clamping projection and the angle element.

2. A clamping device according to claim 1 wherein the angle element is pivotally attached to the support member for pivotal movement of the angle element relative to the support member thereby adjusting the oblique angle between the angle element and the work piece support element.

3. A clamping device according to claim 1 wherein the angle element includes upper and lower projections that extend away from opposite sides of the support member.

4. A clamping device according to claim 3 which further comprises a support element attached to the upper projection for supporting a second clamping device associated with the clamping system.

5. A clamping device according to claim 4, wherein the angle element comprises a plate and the support element extends substantially perpendicular to a plane of the plate.

6. A clamping device according to claim 1 wherein the clamping projection is attached to a sleeve mounted for movement longitudinally along said support member.

7. A clamping device according to claim 6, wherein the locking means comprises a locking mechanism for resisting movement of the sleeve when the locking mechanism is in a locked position and for permitting movement of the sleeve when the locking mechanism is in an unlocked position.

8. A clamping device according to claim 7 wherein the locking mechanism comprises a screw for selectively securing the sleeve in position on the support member.

9. A clamping device according to claim 6 wherein the clamping projection comprises an angle clip extending outwardly from the sleeve.

10. A clamping device according to claim 9 wherein the angle element comprises a plate and the angle clip projects outward from the work piece support surface.

11. A clamping device according to claim 9 wherein the angle clip includes a stop plate extending substantially perpendicularly to the support member.

12. A clamping device according to claim 4 wherein the angle clip includes a stop plate and the stop plate and support member form approximately a 45 degree angle therebetween.

13. A clamping device according to claim 9 wherein the angle clip includes a stop plate and the stop plate and support member form approximately a 22.5 degree angle therebetween.

14. A clamping device for clamping work pieces together at an oblique angle, comprising:

an elongate support member;

an angled plate attached to and projecting outwardly from the support member at an oblique angle, the angled plate having upper and lower projections, the projections extending away from opposite sides of the support member;

an elongate support plate attached to the upper projection of the angled plate, the support plate extending substantially perpendicular to the angled plate;

an angle clip mounted on a sleeve, the sleeve being movable longitudinally along the support member toward and away from the angled plate, the clip being adapted to hold a work piece placed between the clip and the plate; and a locking mechanism coupled to the sleeve and including a screw for resisting sliding movement of the sleeve when the locking mechanism is in a locked position and for permitting sliding movement of the sleeve when the locking mechanism is in an unlocked position.

15. A clamping system for clamping work pieces together at an obtuse angle, comprising:

a first clamping device adapted to support a first work piece having an inclined edge, comprising an elongate support member;

a first plate attached to and projecting outwardly from the support member at an obtuse angle, the first plate comprising opposed upper and lower projections, the projections extending away from opposite sides of the support member;

an elongate support plate attached to the upper projection of the first plate, the support plate extending substantially perpendicular to the first plate;

an angle clip mounted on a sleeve, the sleeve being shiftable longitudinally along the support member toward and away from the first plate, the clip being adapted to hold the first work piece placed between the clip and the first plate; and a locking mechanism comprising a screw for resisting sliding movement of the sleeve when the locking mechanism is in a locked position and for permitting sliding movement of the sleeve when the locking mechanism is in an unlocked position; and a second clamping device adapted to hold a second work piece having an inclined edge portion, comprising an elongate bar having opposite end portions;

a stationary clamp unit secured to one end portion of the bar;

a movable clamp unit slidably mounted on the elongate bar; and the stationary clamp unit being adaptable to engage the support plate of the first clamping device and the movable clamp being adaptable to engage one end of the second work piece so that the first and second work pieces are held together at an obtuse angle and the inclined edge portions of the work pieces are in an abutting clamped relationship.

16. A device for securely holding two work pieces together at an oblique angle, the device comprising:

a first clamp having an elongate support member including a work piece support surface and having a clamp projection longitudinally adjustable along the support member and an angle element coupled to the support member so as to define an angle between the angle element and the work piece support surface, the angle element including a support element arranged substantially orthogonal to the angle element;

a second clamp having a stationary clamp unit and a tightening screw wherein two work pieces can be arranged in an oblique relationship by locating a first work piece on the work piece support surface between the clamp projection and the angle element and locating the stationary clamp unit on the support element of the angle element and locating a second work piece between the angle element and the tightening screw.

17. The device of claim 16 wherein the angle element is pivotally coupled to the support element for pivotal movement between the angle element and the work piece support surface.

18. A clamp device for use in a clamp system including a screw clamp having an elongate bar with a stationary clamp unit attached to one end thereof and a movable clamp unit located along the bar, the movable clamp unit including a tightening screw, the clamp device comprising:

an elongate support element, a clamp projection, and an angle element, the support element having a work piece support surface, the clamp projection being coupled to the support element for movement therealong, the angle element being coupled to the support element and arranged so as to define an oblique angle between the work piece support surface and the angle element, the angle element further including a clamp support surface for supporting a screw clamp of a clamp system whereby a first work piece can be arranged proximate the work piece support surface between the angle element and the clamp projection and a second work piece can be arranged obliquely to the first work piece and held in position by the screw clamp.

* * * * *